US009291414B2

(12) United States Patent
Gomez

(10) Patent No.: US 9,291,414 B2
(45) Date of Patent: Mar. 22, 2016

(54) FIREARM BUFFER SYSTEM AND BUTTSTOCK ASSEMBLY

(71) Applicant: LWRC INTERNATIONAL LLC, Trappe, MD (US)

(72) Inventor: Jesus S. Gomez, Trappe, ME (US)

(73) Assignee: LWRC International LLC, Cambridge, MD (US)

( * ) Notice: Subject to any disclaimer, the term of this patent is extended or adjusted under 35 U.S.C. 154(b) by 0 days.

(21) Appl. No.: 14/577,503

(22) Filed: Dec. 19, 2014

(65) Prior Publication Data

US 2015/0260469 A1 Sep. 17, 2015

Related U.S. Application Data

(62) Division of application No. 13/837,697, filed on Mar. 15, 2013, now Pat. No. 8,943,947.

(51) Int. Cl.

| | |
|---|---|
| ***F41A 3/84*** | (2006.01) |
| ***F41A 3/78*** | (2006.01) |
| ***F41C 23/06*** | (2006.01) |
| ***F41C 23/22*** | (2006.01) |
| ***F41A 5/18*** | (2006.01) |

(52) U.S. Cl.

CPC ... *F41A 3/84* (2013.01); *F41A 5/18* (2013.01); *F41C 23/06* (2013.01); *F41C 23/22* (2013.01)

(58) Field of Classification Search

CPC ..... F41A 3/54; F41A 3/56; F41A 3/66; F41A 3/68; F41A 3/70; F41A 3/78; F41A 3/80; F41A 3/82; F41A 3/84; F41A 5/10; F41C 23/00; F41C 23/04; F41C 23/06; F41C 23/14

See application file for complete search history.

(56) References Cited

U.S. PATENT DOCUMENTS

| | | | | | |
|---|---|---|---|---|---|
| 1,568,005 | A | * | 12/1925 | Sutter | F41A 3/78 89/198 |
| 2,377,692 | A | * | 6/1945 | Johnson, Jr. | F41A 3/70 89/172 |
| 2,424,194 | A | | 7/1947 | Sampson et al. | |
| 2,426,563 | A | * | 8/1947 | Patchett | F41A 3/78 89/198 |
| 2,532,794 | A | * | 12/1950 | Teece | F41A 19/02 89/129.02 |
| 4,028,993 | A | * | 6/1977 | Reynolds | F41A 19/03 89/130 |
| 4,677,897 | A | * | 7/1987 | Barrett | F41A 3/26 89/148 |
| 5,038,666 | A | * | 8/1991 | Major | F41A 3/80 42/25 |

(Continued)

OTHER PUBLICATIONS

In the U.S. Patent and Trademark Office, Requirement for Restriction/Election in re: U.S. Appl. No. 13/837,697, dated Jul. 16, 2014, 7 pages.

(Continued)

*Primary Examiner* — Bret Hayes
*Assistant Examiner* — Derrick Morgan
(74) *Attorney, Agent, or Firm* — Porzio, Bromberg & Newman, P.C.

(57) ABSTRACT

A buttstock assembly configured to work in conjunction with a compact buffer assembly consisting of a buffer tube, spring and bolt carrier with an integral buffer is provided. The buttstock assembly, buffer tube and bolt carrier are configured to work with AR15/M16 type firearms and their derivatives. By incorporating the buffer onto the bolt carrier, which is used in conjunction with a buffer tube of reduced length, the overall length of the host firearm is reduced by approximately 3.2 inches. No permanent modification need be made to the host firearm in order to utilize the compact buffer assembly and buttstock assembly disclosed herein.

5 Claims, 20 Drawing Sheets

(56) References Cited

U.S. PATENT DOCUMENTS 5,173,564 A * 12/1992 Hammond, Jr. ..... F41C 23/00 42/75.03
5,448,940 A 9/1995 Schuetz et al.
5,726,377 A * 3/1998 Harris ..... F41A 19/14 42/65
5,827,992 A 10/1998 Harris et al.
6,019,024 A 2/2000 Robinson et al.
6,564,492 B2 5/2003 Weldle et al.
6,829,974 B1 * 12/2004 Gwinn, Jr. ..... F41A 3/70 89/130
7,137,217 B2 11/2006 Olson et al.
7,162,822 B1 * 1/2007 Heayn ..... F41C 23/04 42/71.01
7,213,498 B1 * 5/2007 Davies ..... F41A 3/94 42/74
7,478,495 B1 * 1/2009 Alzamora ..... F41C 23/06 42/74
7,793,453 B1 * 9/2010 Sewell, Jr. ..... F41C 23/04 42/73
8,061,072 B1 11/2011 Crose
8,186,090 B1 * 5/2012 Chiarolanza ..... F41C 23/04 42/73
8,375,616 B2 2/2013 Gomez et al.
8,387,513 B2 3/2013 Gomez et al.
8,393,107 B2 * 3/2013 Brown ..... F41C 7/00 42/105
8,418,389 B1 * 4/2013 Lukman ..... F41A 5/10 42/1.06
8,631,601 B2 * 1/2014 Langevin ..... F41C 23/04 42/73
8,689,672 B2 * 4/2014 Cassels ..... F41A 5/26 42/69.02
8,769,855 B2 * 7/2014 Law ..... F41C 23/14 42/73
8,943,947 B2 2/2015 Gomez
8,955,422 B1 * 2/2015 Schumacher ..... F41A 3/12 42/72
2005/0223613 A1 * 10/2005 Bender ..... F41A 5/24 42/16
2007/0234897 A1 * 10/2007 Poff ..... F41A 3/94 89/198
2009/0151213 A1 * 6/2009 Bell ..... F41A 19/33 42/69.03
2010/0071246 A1 * 3/2010 Vesligai ..... F41C 23/04 42/75.03
2010/0242334 A1 * 9/2010 Kincel ..... F41C 23/04 42/74
2011/0094373 A1 * 4/2011 Cassels ..... F41A 5/26 89/191.01
2012/0030983 A1 * 2/2012 Kuczynko ..... F41C 23/04 42/73
2012/0137872 A1 6/2012 Crommett
2013/0192114 A1 * 8/2013 Christenson ..... F41A 3/84 42/16
2013/0269510 A1 * 10/2013 Sullivan ..... F41A 5/28 89/193
2014/0041518 A1 * 2/2014 Neitzling ..... F41A 3/26 89/191.01
2014/0068987 A1 * 3/2014 Burt ..... F41C 23/16 42/16
2014/0190056 A1 * 7/2014 Troy ..... F41C 23/14 42/71.01

OTHER PUBLICATIONS

In the U.S. Patent and Trademark Office, Notice of Allowance in re: U.S. Appl. No. 13/837,697, dated Sep. 30, 2014, 10 pages.

* cited by examiner

FIREARM BUFFER SYSTEM AND BUTTSTOCK ASSEMBLY

This application is a divisional of U.S. patent application Ser. No. 13/837,697, filed Mar. 15, 2013. The contents of which are incorporated herein in its entirety.

BACKGROUND OF THE INVENTION

1. Field of the Invention

The invention relates in general, to gas-operated firearms. More particularly, the present invention relates to the buffer system and buttstocks of autoloading firearms in the AR15/M16/M4 series of firearms.

2. Description of the Related Art

Militaries worldwide rely on a variety of firearms for both defensive and offensive purposes. In general, these firearms are divided into various subcategories based on the firearms structural features and the ammunition type used. Example categories include, but are not limited to, handguns, submachine guns and rifles. All three listed categories of weapons are often issued as the primary individual weapon for soldiers or police forces, based on the task the user is expected to perform.

Handguns and submachine guns are selected because they are light and compact. Their diminutive size allows for easy transportation, deployment and use within a vehicle while their weight makes them ideal for daily carry. The submachine gun, while being slightly more obtrusive than the handgun, increases the firepower and hit probability of the user. Hit probability is primarily increased due to the user having three points of contact with the weapon, compared to only having two points of contact as is the case with a handgun.

The buttstock present on many submachine guns offers a unique point of contact between the user and the firearm, a well known advantage. Handguns and submachine guns fire ammunition cartridges typically associated with handguns, so called pistol ammunition. Handgun cartridges such as 9 mm, .40S&W and 45ACP offer acceptable terminal performance when compared against many other handgun cartridges, but offer poor performance when measured against typical rifle cartridges such as 5.56×45 mm (5.56 mm) and 7.62×51 mm (7.62 mm) ammunition. Additionally, a handgun's optimal performance range is 25-50 yards while a submachine gun using similar ammunition may extend the effective range of the cartridges out to 100-150 yards. The effective range is dependent on which specific handgun cartridge is being used. It must be noted that while a handgun cartridge being fired from a submachine gun may have an effective range up to 150 yards, meaning it is capable of sufficiently penetrating the target, it will generally have poor terminal performance on the intended target at that range.

This poor terminal performance is because most defensive handgun ammunition uses hollow point bullet construction, or other expanding design, which will not expand consistently past 25-50 yards due to a lack of velocity. Handgun ammunition is also generally deficient in penetrating intermediate barriers such as wood, auto bodies and laminate glass while at the same time remaining terminally effective at all but the closest ranges, i.e. 25 yards and less.

The next class of firearms is rifles, a class often subdivided into carbines and rifles based on barrel length and other characteristics of the firearm. For the purpose of this disclosure the term "rifle" will include carbines unless otherwise noted. Rifles are the primary armament of militaries worldwide. An example rifle would be the M16/M4 family of firearms and many of its derivatives such as the M6 piston driven design produced by LWRC International. Rifles typically have an effective range exceeding 600 yards. Rifle cartridges such as the 5.56 mm and 7.62 mm offer drastically increased intermediate barrier penetration, terminal performance, and superior external ballistics characteristics when compared to any handgun cartridge. The down side to a rifle is typically its overall length and to a lesser extent, its weight. Size restrictions make it difficult for tank and aircraft crews for example, to carry a rifle. This often leaves people confined to tight quarters armed with submachine guns at best, or pistols at worst. Should these crews be required to deploy their weapons in a violent confrontation they will immediately be disadvantaged when confronted by enemy forces equipped with rifles, to include the ubiquitous AK47 frequently used by enemy forces. As such, there is a persistent need to provide a firearm which offers the terminal and external ballistics, and intermediate barrier penetration capabilities of a rifle but in a package which is no larger than a submachine gun.

Attempts to provide a firearm which has the compact size of a submachine gun, capable of firing ammunition with terminal and external ballistic similar to a rifle have been made. Many of these designs are referred to as Personal Defense Weapons (PDW). Designs which try to incorporate all of these features have been around for many years. Many previous attempts to produce a PDW failed because the design relied on a proprietary ammunition cartridge, was insufficiently compact, non-ergonomic, or simply unreliable. It should be noted that PDWs for the purpose of this disclosure only includes those designs which are capable of firing what is generally considered rifle ammunition. PDW designs which fire handgun ammunition such as 9×19 mm, .40S&W, .45ACP, FN 5.7 mm and HK 4.6 mm ammunition generally rely on operating systems which are not capable of firing traditional rifle ammunition. Further, such rounds do not have external or terminal ballistic characteristics comparable to conventional rifle ammunition and are not capable of satisfying the needs of many military and law enforcement end users.

Without being an exhaustive list, the following U.S. Patents disclose various features which are of importance for understanding the improvements provided by the invention as set forth herein. Neither of the two patents mentioned below are admitted to be prior art by the Applicant.

U.S. Pat. No. 5,827,992 to Harris et al (Harris) has several inherent deficiencies in its design that are evidenced by the fact that it never experienced wide acceptance or adoption by any military or police forces. First among these is that the design relies on the use of a new cartridge, the 5.56×30 mm MARS as taught by Harris (see column 9, lines 29-62). Militaries and police forces are slow and often reluctant to adopt new proprietary cartridges due to logistics concerns, unknown terminal performance and cost. Second, Harris does not teach how to make an M16 type rifle capable of firing rifle ammunition that is sufficiently compact to meet the needs of modern end users. In particular, the buffer system so disclosed would not provide for an M16 type weapon having an overall length of 20" or less when equipped with an 8" barrel, a requirement for some government contracts. Third, to practice the invention as taught requires the production of a M16 type receiver which dimensionally deviates from the prior art. This would substantially increase the implementation cost of adopting such a design.

U.S. Pat. No. 7,137,217 to Olson and Knight discloses a compact rifle design which relies on an entirely new gas operating system and ammunition cartridge. The proprietary nature of this new firearm, its ergonomics and operating system, and the unique ammunition it uses greatly diminishes the likelihood of its adoption by military or other government forces.

Among military and police forces of the Western world, the AR15/M16 family of firearms and their derivatives, including indirect gas operated versions (piston designs), have been in use for many years. Western nations have trained millions of individuals in the use of these firearms, therefore creating a weapon based on the AR15/M16 design is desirable as the deployment cost resulting from the adoption of a modified weapon system based on the AR15/M16 will be minimal. In addition, designing a new compact weapon system which uses conventional rifle ammunition further reduces deployment cost and logistics concerns.

Compact personal defense weapons based on the AR15/M16 family of firearms are prevalent throughout the prior art. The primary method of reducing the overall length of the rifle has been to reduce the length of the barrel and gas operating system. While this is a valid method of reducing overall length it is not without shortcomings. First, the barrel may only be shortened so much before the external and terminal ballistics characteristics of a rifle projectile are diminished. Second, the shortened barrel reduces dwell time, which is critical to the proper firing cycle of the host rifle. Dwell time is the time between the projectile passing a barrels gas port and when it exits the muzzle of the firearm. This is an important component to the proper function of the firearm. Third, the increased gas pressure generated by many of the prior art rifle designs results in a phenomenon known as bolt bounce. Bolt bounce occurs when the bolt carrier of an AR15/M16 rifle reciprocates so violently that upon its forward movement the bolt carrier bounces back from the chamber end of the barrel. This results in the bolt unlocking from the chamber extension and the bolt carrier absorbing a significant amount of the hammer's force, resulting in a failure to fire. To combat bolt bounce, numerous buffers have been designed that work with varying degrees of success.

Even with a barrel of reduced length, the overall length of the AR15/M16 family of firearms is still restricted by the length of the prior art buffer tube, which is nearly ubiquitous throughout the art.

Shown in FIG. 1A is the prior art carbine buffer assembly used with the AR15/M16 family of firearms. The buffer assembly 300 includes a carbine length buffer tube 330, spring 340, bolt carrier 310, bolt 311 and buffer 320. The rear end of the bolt carrier 310 abuts the front of the buffer 320 when the host rifle is fully assembled. The buffer 320 is contained within the buffer tube 330 and the bolt carrier 310 within an upper receiver when in battery. The bolt carrier 310 (6.672" long) and buffer 320 (3.245" long) have a combined length of over 9.9". While the carbine buffer tube 330 does not receive the entire length of the bolt carrier 310 during its reciprocating motion, the 7.19" length of the prior art carbine buffer tube is required to facilitate sufficient rearward movement of the bolt carrier 310 and compression of the spring 340 for proper function of the host firearm. The spring 340 and buffer 320 are required to provide a surface and force which resists the rearward movement of the bolt carrier 310. The weight of the buffer 320 is selected to minimize bolt bounce and assist in the proper operation of the gas operating system. As a result, the prior art carbine buffer assembly 300 adds a fixed amount of additional length to AR15/M16 type firearms so equipped.

Therefore in consideration of what is available in the prior art, it would be desirable to have a PDW that uses conventional rifle ammunition, has a barrel long enough to provide terminal and external ballistic similar to a rifle and has an overall length similar to a submachine gun. Additionally, it would be desirable to incorporate the above features onto a firearm having minimal structural and operational differences as compared to the prior art M16/M4 family of firearms.

SUMMARY OF THE INVENTION

In view of the foregoing, one object of the present invention is to overcome the shortcomings in the design of personal defense weapons as described above.

Another object of the present invention is to provide a buffer assembly having a bolt carrier with a buffer integrated onto its rearward end.

Yet another object of the present invention is to provide a buffer assembly in accordance with the preceding objects which includes a spring and buffer tube configured to receive and facilitate the reciprocating movement of the bolt carrier and buffer during operation of the host firearm.

A further object of the present invention is to provide a buffer assembly in accordance with the preceding objects which is capable of facilitating proper reciprocating movement of the bolt carrier when the host firearm is firing rifle caliber ammunition.

A still further object of the present invention is to provide a buffer assembly in accordance with the preceding objects which reduces the overall length of an AR15/M16/M4 type rifle as compared to a similarly equipped AR15/M16/M4 type rifles using the prior art buffer and buffer tube assembly.

Another object of the present invention is to provide a buffer assembly in accordance with the preceding objects which can be installed on prior art AR15/M16 type firearms without modification of the receiver assembly.

Yet another object of the present invention is to provide for an adjustable buttstock which is capable of operating while attached to a buffer assembly produced in accordance with the preceding objects.

In accordance with these and other objects, the present invention is directed to a buffer assembly and buttstock for use with gas operated firearms, particularly those of the AR15/M16/M4 variety, which is configured to reduce the overall length of the host firearm. This buffer system can be retrofitted to an existing AR15/M16/M4 type firearm without the need for any modification to the receiver of the firearm.

The compact buffer assembly provided for herein includes a buffer tube, spring, bolt carrier with an attached buffer and a buttstock assembly. The bolt carrier is generally cylindrical in shape, incorporates a boss about the rear end and has been reduced in length as compared to those found in the prior art. Further, the rear of the bolt carrier has been constructed to receive a portion of the spring and thereby prevent the spring from binding during the bolt carrier's reciprocating movement. A two part buffer has been incorporated onto the rear end of the modified embodiment bolt carrier. The two portions of the buffer are welded together once installed onto the bolt carrier. By integrating the buffer onto the bolt carrier the overall length of these two components is reduced. This reduction in length facilitates a reduction in the length of the buffer tube thereby making the entire buffer assembly more compact.

In addition, the bolt carrier/buffer combination provides sufficient mass to prevent bolt bounce from occurring, even when a short barrel is used in conjunction with the buffer assembly.

Still further, the present invention reduces the overall length of an equipped firearm by at least 3.2 inches when compared against the prior art.

These together with other improvements and advantages which will become subsequently apparent reside in the details of construction and operation as more fully hereinafter described and claimed, reference being made to the accompanying drawings forming a part hereof, wherein like numerals refer to like parts throughout.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended to define the limits of the invention.

DETAILED DESCRIPTION OF THE PREFERRED EMBODIMENT

Figure 1A:
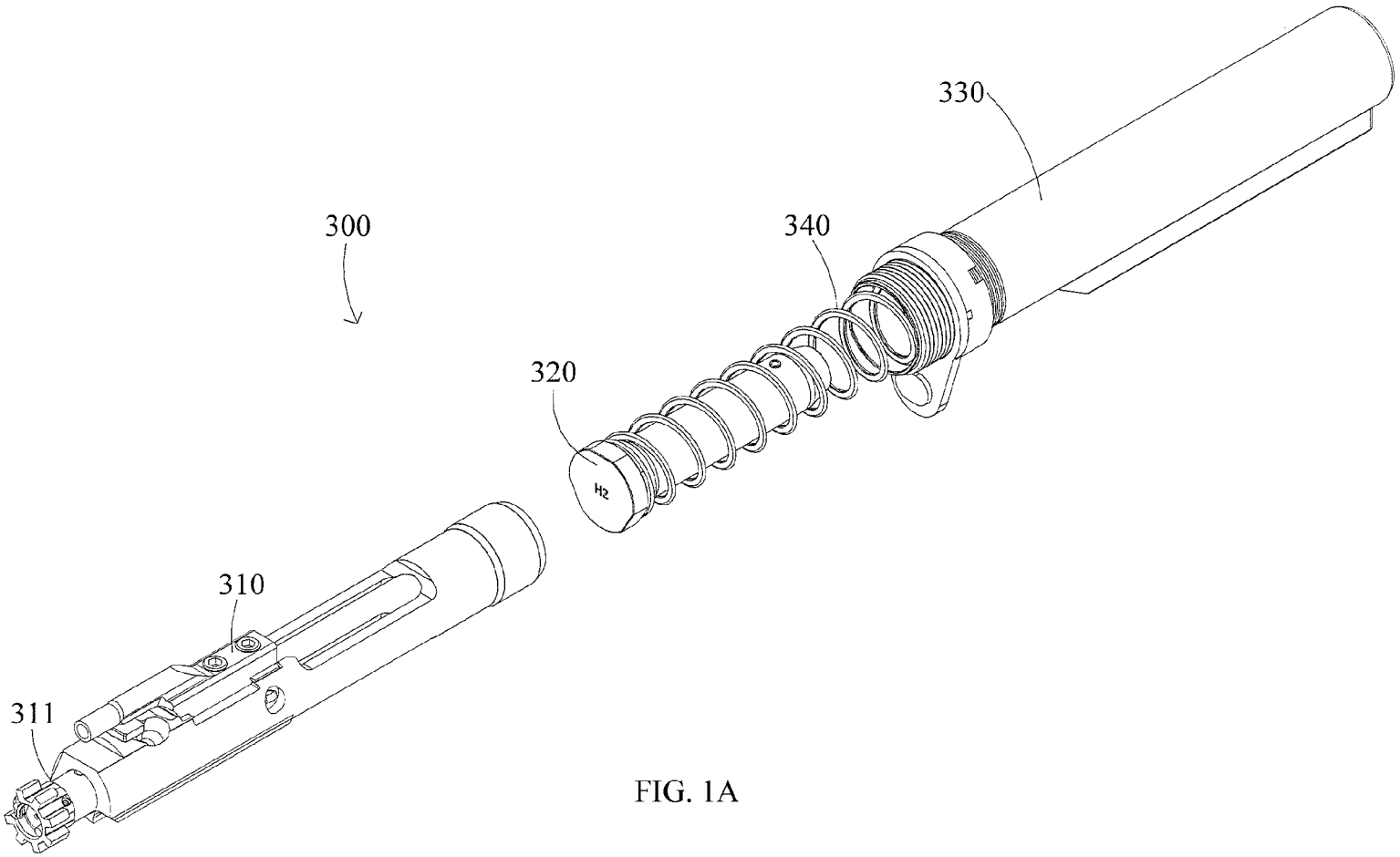
FIG. 1A is a perspective side view of the prior art buffer assembly which is comprised of a buffer tube, spring, and buffer shown with an AR15/M16/M4 type bolt and bolt carrier.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

The present invention is directed towards a compact buffer assembly for use with AR15/M16 type firearms to include, for example, the M4, AR10, SR25 and piston operated designs such as LWRC International's M6 series of rifles. As used herein, the phrase "bolt carrier group" and "bolt carrier assembly" are used interchangeably.

Unless otherwise specified, the various components which make up the trigger mechanism, upper receiver assembly, lower receiver assembly, bolt and bolt carrier assembly are those found on prior art AR15/M16 type firearms.

As used herein, the word "front" or "forward" corresponds to the end of the bolt carrier 20 where the bolt 11 is located (i.e., to the left as shown in FIGS. 1B-3, & 5); "rear" or "rearward" or "back" corresponds to the direction opposite the end of the bolt carrier 20 where the bolt 11 is located (i.e., to the right as shown in FIGS. 1B-3, & 5). The phrase "in battery" or "battery" refers to the position of readiness of a firearm for firing.

Figure 1B:
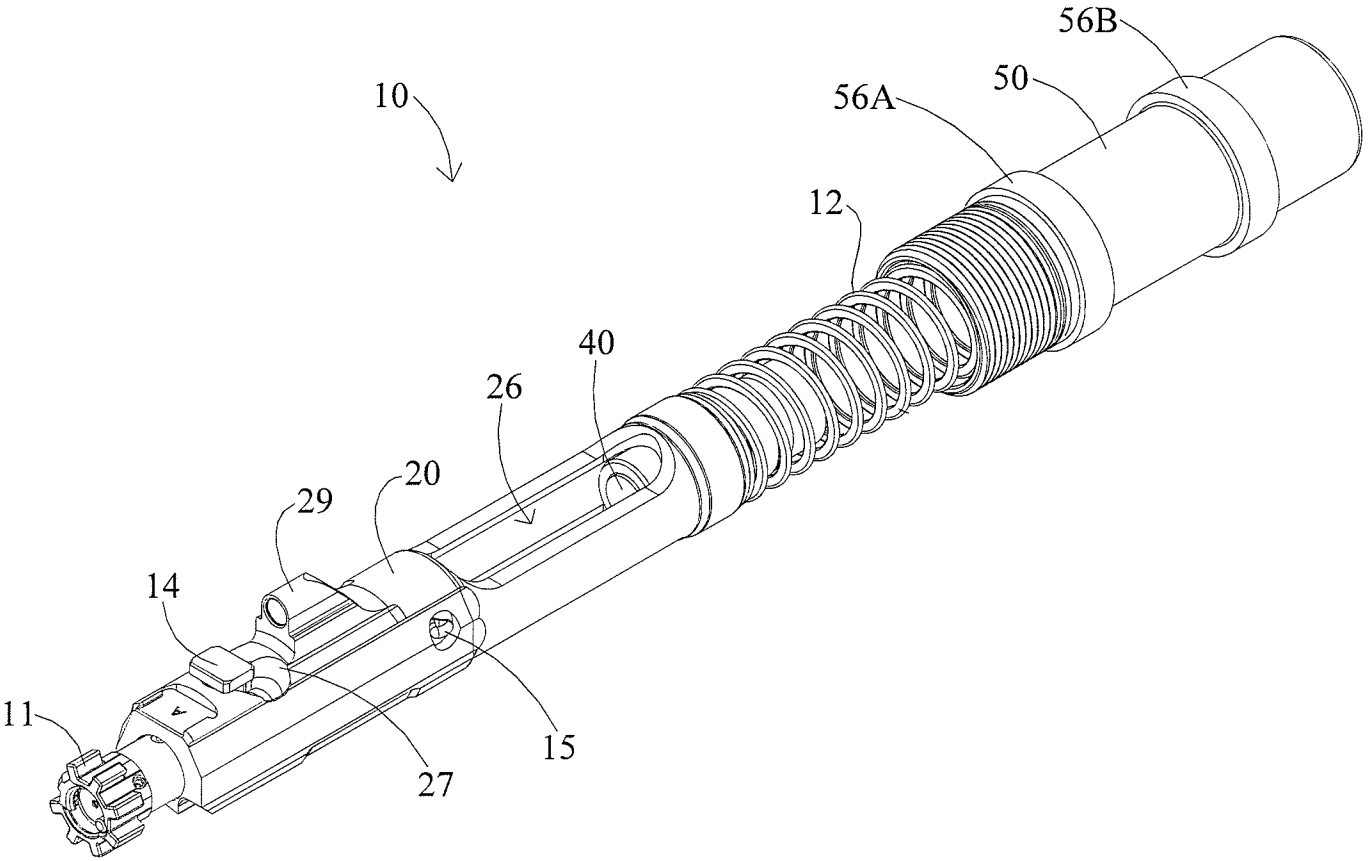
FIG. 1B is a side perspective view of a buffer assembly including a bolt carrier with attached buffer, buffer tube and spring in accordance with the present invention.

As shown in FIG. 1B, the present invention is directed to a compact buffer assembly, generally designated by reference numeral 10, including a generally cylindrical bolt carrier 20 with an attached buffer 40, a bolt 11, a buffer spring 12 and a buffer tube 50 (e.g., approximately 3.9" long) having an interior configured to receive a portion of the bolt carrier 20 therein. It will be understood that the buffer assembly 10 is intended to be employed with any of the various AR15/M16 type firearms; however with minor modifications, some of its features could be more widely used for other firearms as well. It will also be understood that the bolt carrier 20 with attached buffer 40 is housed within an upper receiver 81 of an AR15/M16 type rifle 80 (see FIGS. 6A-6G and 7).

In FIGS. 1B-4, an embodiment of the bolt carrier 20 is shown. The bolt carrier 20 is generally cylindrical in shape and includes a bore 30 which extends between its front end 31 and back end 32, varying in dimension based on a specific region's function and the structure defined thereon. The bolt carrier 20 also includes a hammer clearance slot 26 which permits the hammer to extend into the bolt carrier 20 and strike a firing pin 13 positioned in a portion of the bore 30. The firing pin 13 is retained in place through the use of a cotter pin 15, also commonly referred to as a firing pin retaining pin.

The exterior of the bolt carrier 20 includes an ejection port cover opener 28 which provides room for the ejection port cover to close and a cam slot 27 which provides a contained area for the cam pin 14 to rotate and thereby facilitate limited rotational and longitudinal movement of an attached bolt 11 (see FIGS. 1B, 2, 3 and 4).

Located on the top surface of the bolt carrier 20 is an integral carrier key 29. The general features and advantages of the integral carrier key 29 are described in U.S. Pat. No. 8,387,513, filed on May 14, 2010, entitled "Self Loading Firearm Bolt Carrier With Integral Carrier Key And Angled Strike Face", by Jesus S. Gomez, Jason Miller, Robert S. Schilling, and Michael R. Llewellyn (hereinafter, "the Gomez et al application"), which is also owned by the assignee of the present application and is hereby expressly incorporated by reference as if fully set forth herein.

Figure 2:
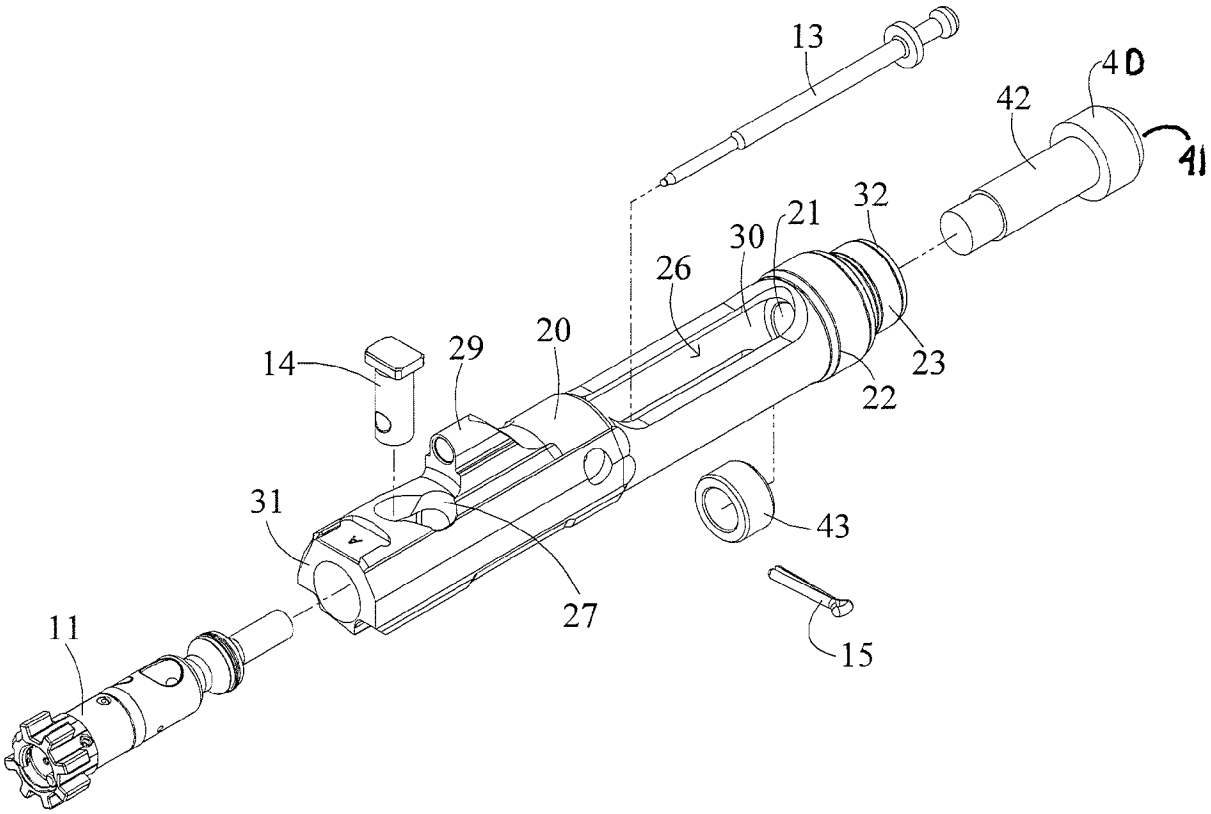
FIG. 2 is an exploded perspective view of a bolt carrier assembly including a bolt, a bolt carrier, and a buffer in accordance with the present invention.
Figure 3:
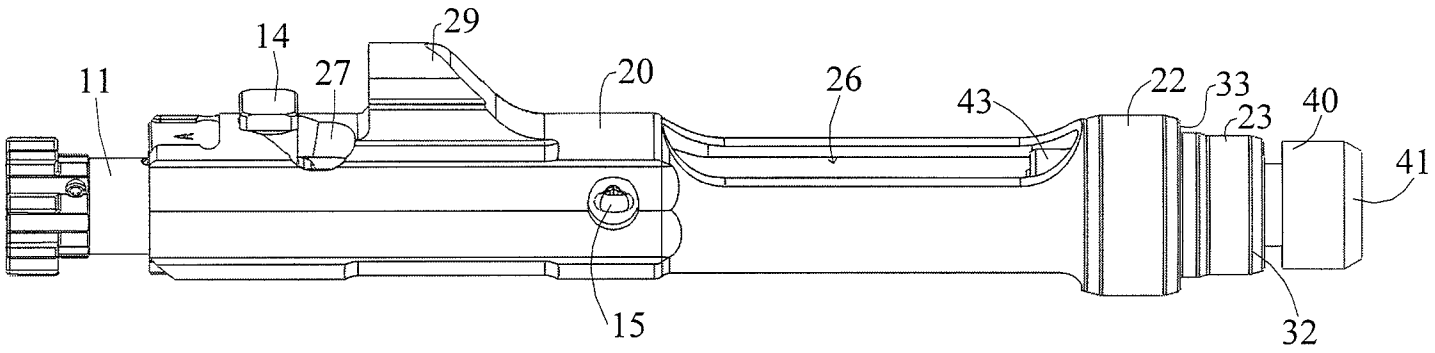
FIG. 3 is a side perspective view of one side of the bolt carrier with attached buffer included in the buffer assembly shown in FIG. 1B.
Figure 4:
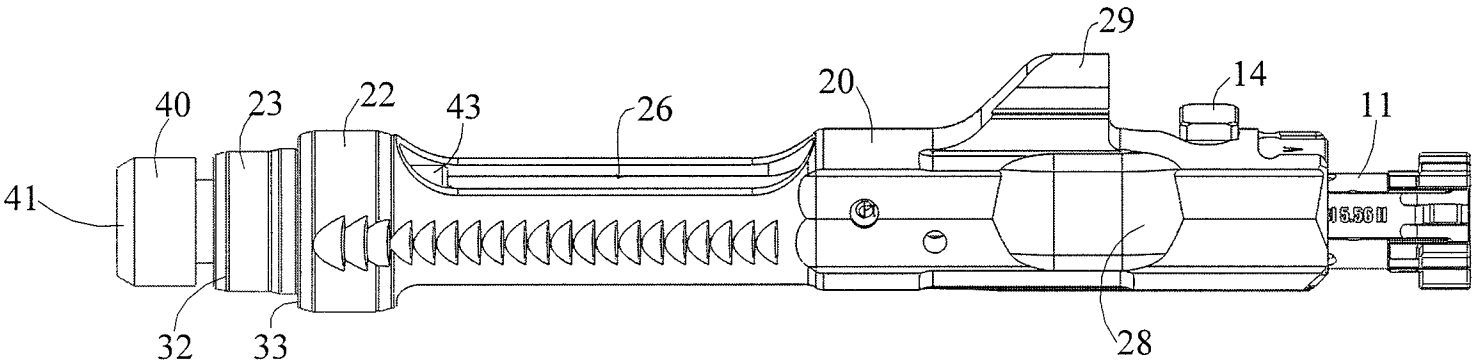
FIG. 4 is a side perspective view of another side of the bolt carrier with attached buffer included in the buffer assembly shown in FIG. 1B.

As shown in the exploded view of the bolt carrier 20 and buffer 40 provided in FIG. 2, and the isolated views of the same shown in FIGS. 3-4, the buffer 40 is attached to the back end of the bolt carrier 20. The bolt carrier 20 has a bore 21 through the interior of its back end which receives a portion of the buffer 40. The buffer 40 consist of two parts, a bumper 41 with integral shaft 42 and a cylindrical weight 43 attached thereto. The method of attaching the weight 43 to the shaft 42 of the bumper 41 will be described more fully hereinafter.

Horizontal side views of the bolt carrier 20 with attached buffer 40 are provided in FIGS. 3 and 4. The rear of the bolt carrier 20 has a boss 22 for contacting an interior portion 86 of the upper receiver 81 (see FIG. 7), thereby providing support during its longitudinal movement therein. The boss 22 is generally cylindrical in shape having an outside diameter larger than the body portion of the bolt carrier 20. The boss is also of sufficient diameter to make contact with the cylindrical interior of the buffer tube 50 (FIGS. 1B and 7) to ensure that the bolt carrier 20 remains centered therein. The boss 22 defines a circular side wall 33 (FIGS. 3-5) on its backside which occupies a plane perpendicular to the longitudinal axis of the bolt carrier. The general features and advantages of the boss 22 are described in a U.S. Pat. No. 8,375,616 filed on Dec. 10, 2008, entitled "Automatic Rifle Bolt Carrier with Fluted Boss", by Jesus S. Gomez and Jason Miller (hereinafter, "the Gomez and Miller application"), which is also owned by the assignee of the present application and is hereby expressly incorporated by reference as if fully set forth herein. Also present on the rearward end of the bolt carrier is a guide rod portion 23 (FIGS. 2-5) which is configured to engage with and support the buffer spring 12 (shown in FIG. 1B) as will also be described more fully hereinafter.

Figure 5:
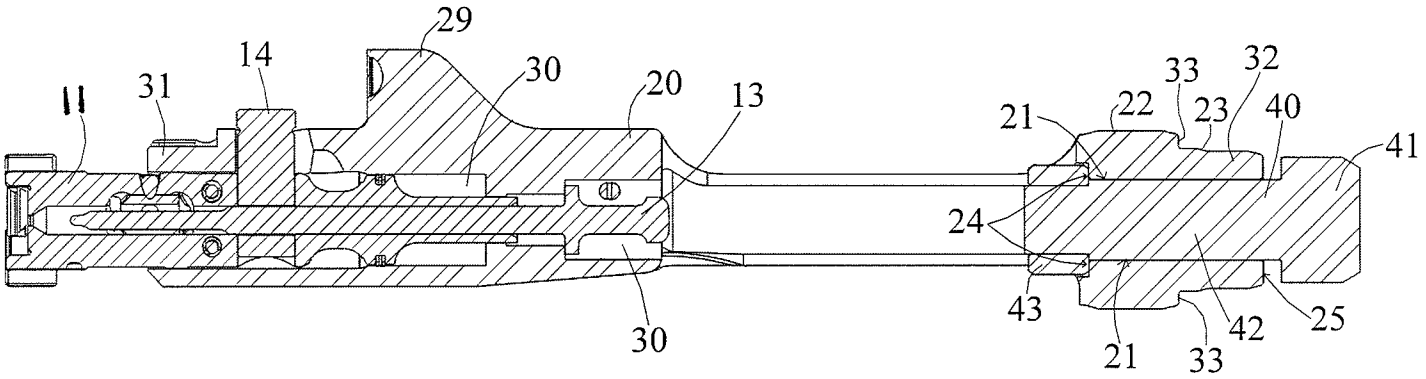
FIG. 5 is a perspective cutaway view of the bolt carrier shown in FIG. 3.
Figure 6A:
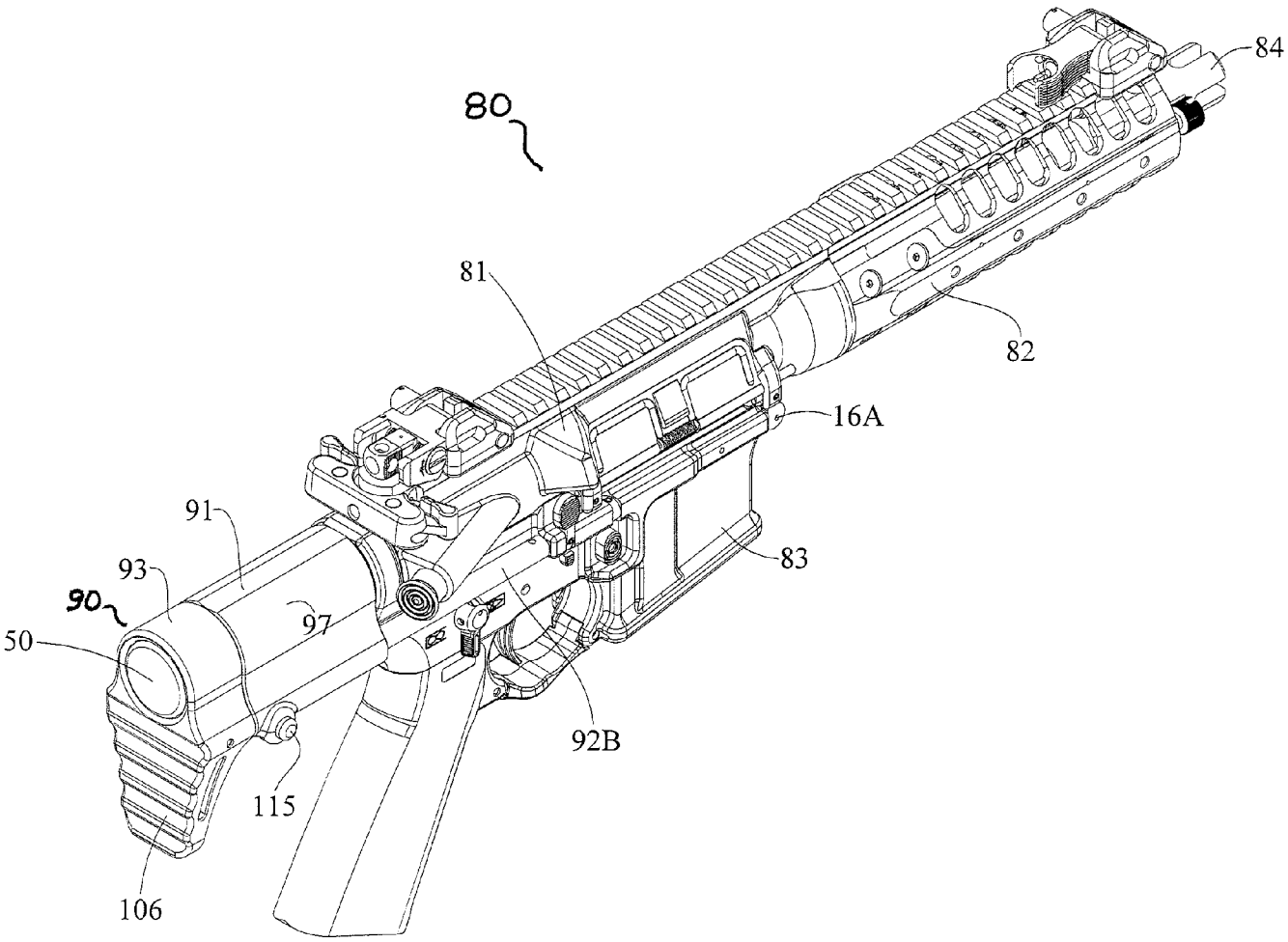
FIG. 6A is a perspective side view of a personal defense weapon equipped with a buffer assembly and buttstock in accordance with the present invention.
Figure 6B:
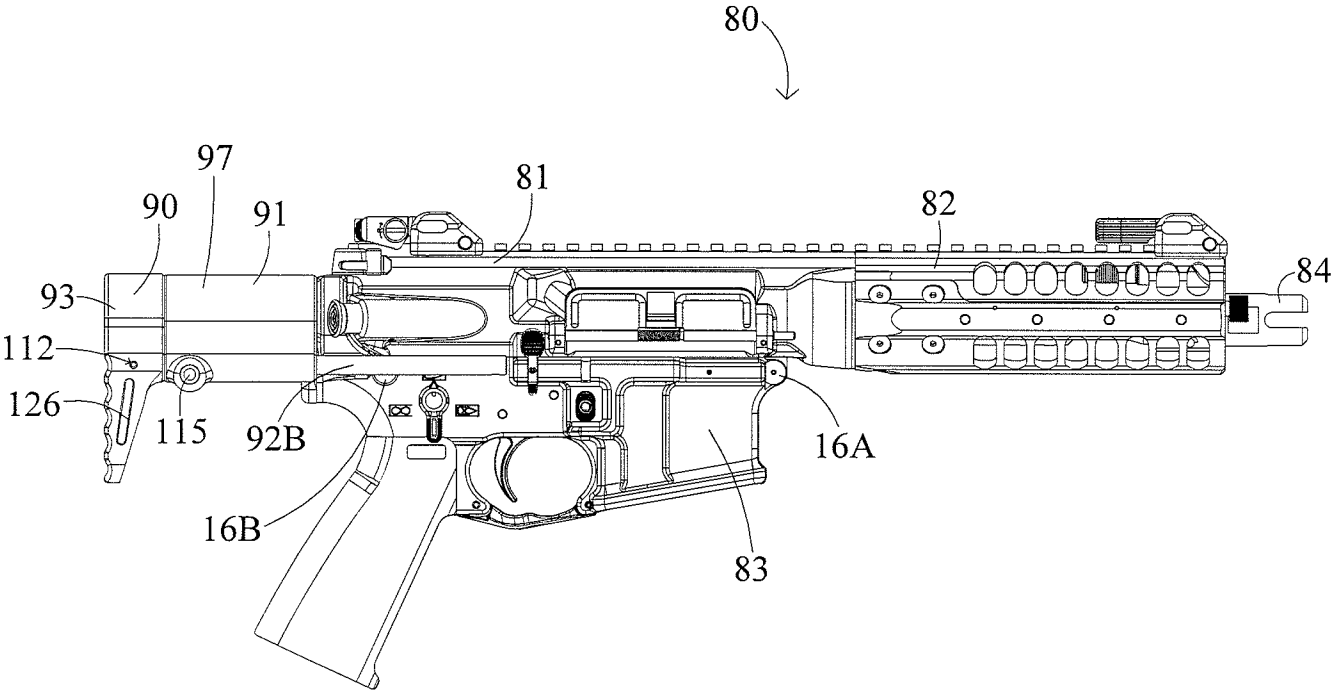
FIG. 6B is a side view of the firearm shown in FIG. 6A.
Figure 6C:
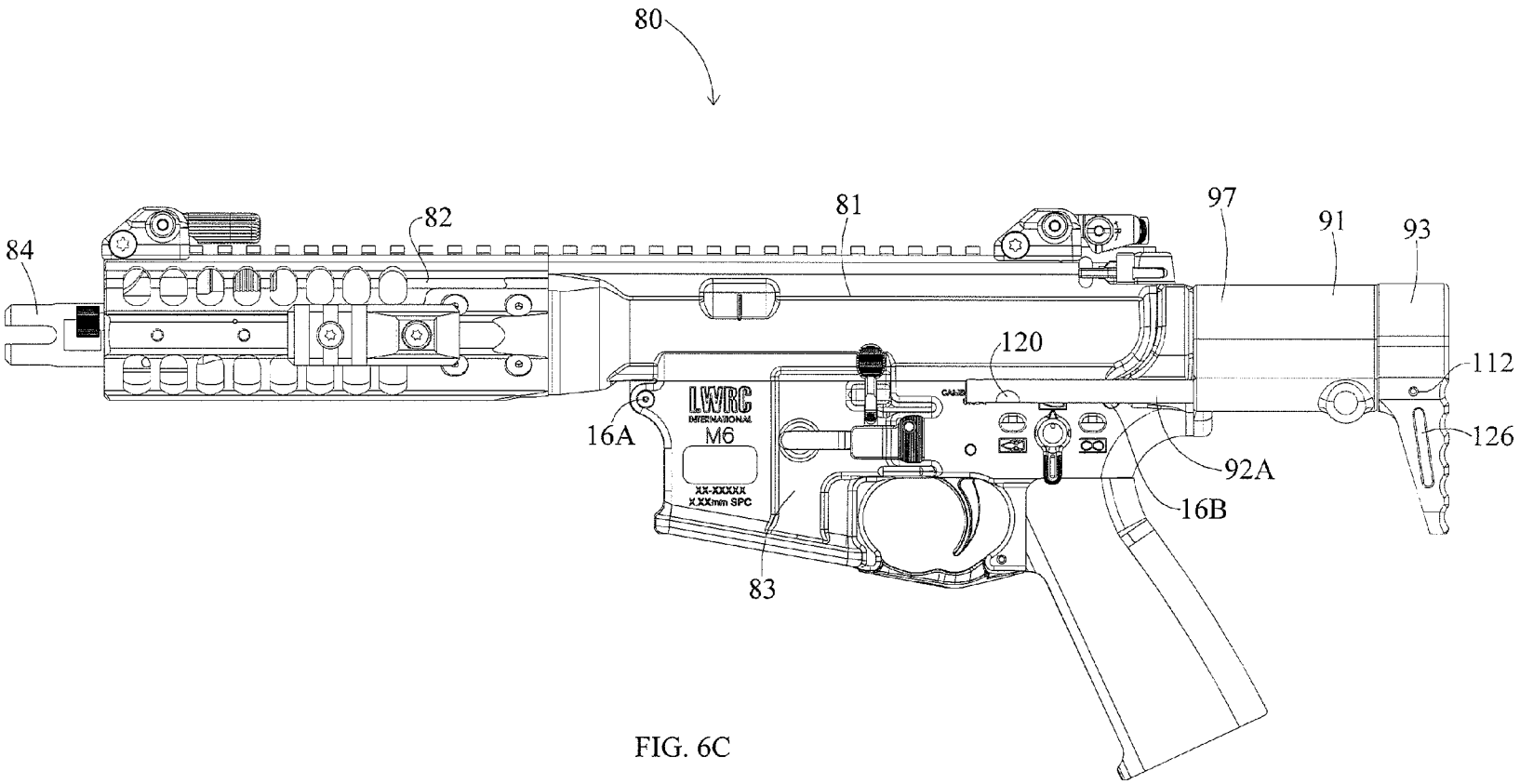
FIG. 6C is another side view of the firearm shown in FIG. 6A.
Figure 6D:
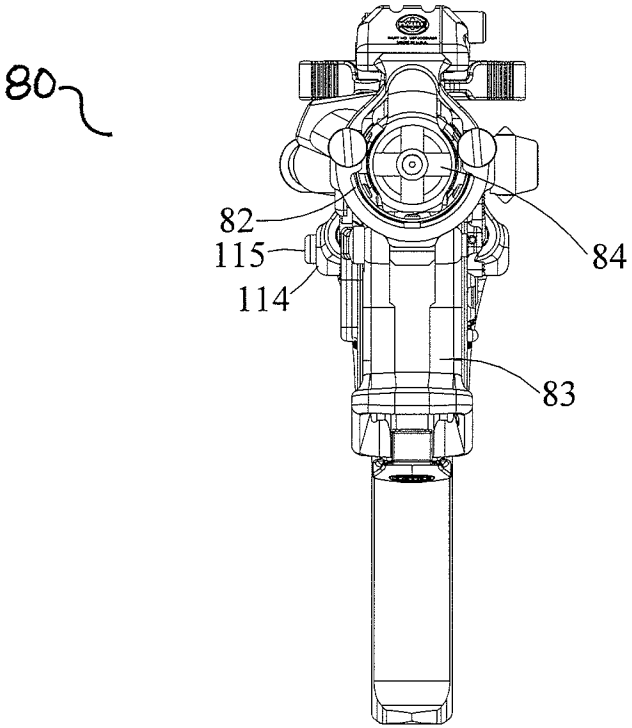
FIG. 6D is a front view of the firearm shown in FIG. 6A.
Figure 6E:
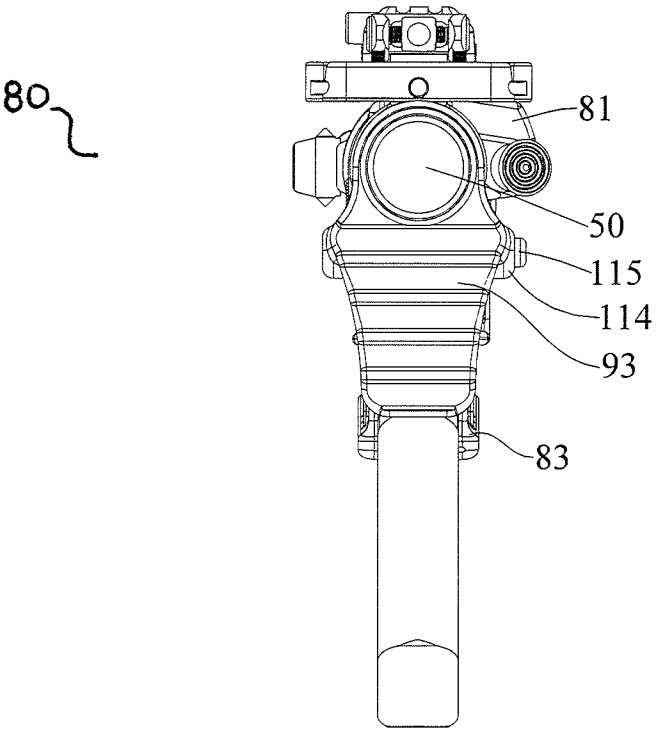
FIG. 6E is a back view of the firearm shown in FIG. 6A.
Figure 6F:
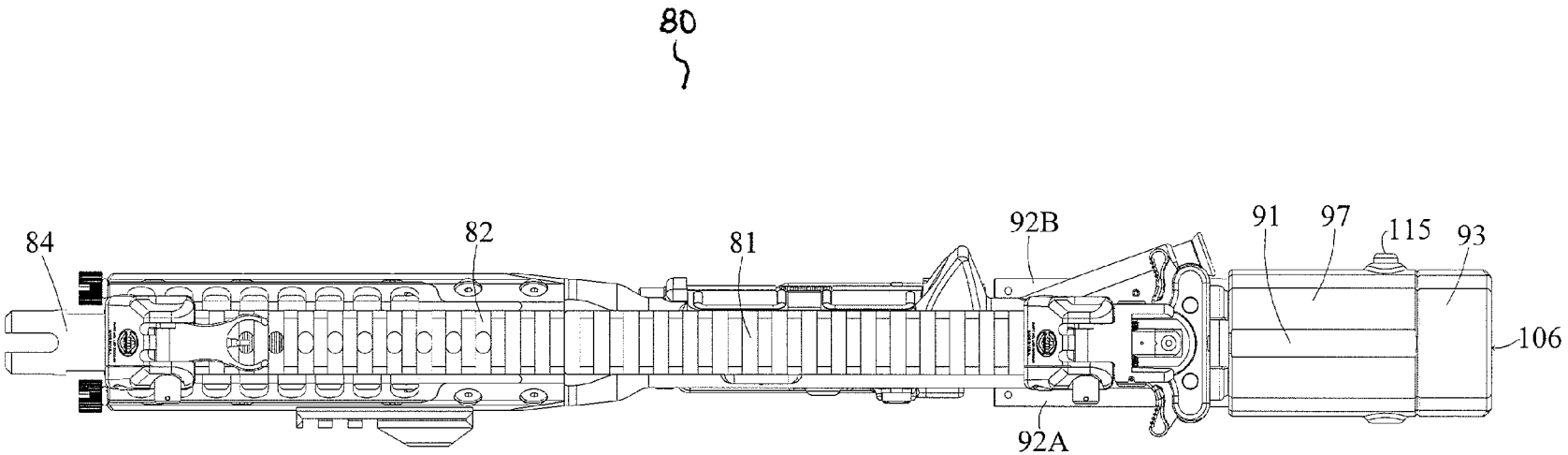
FIG. 6F is a top view of the firearm shown in FIG. 6A.
Figure 6G:
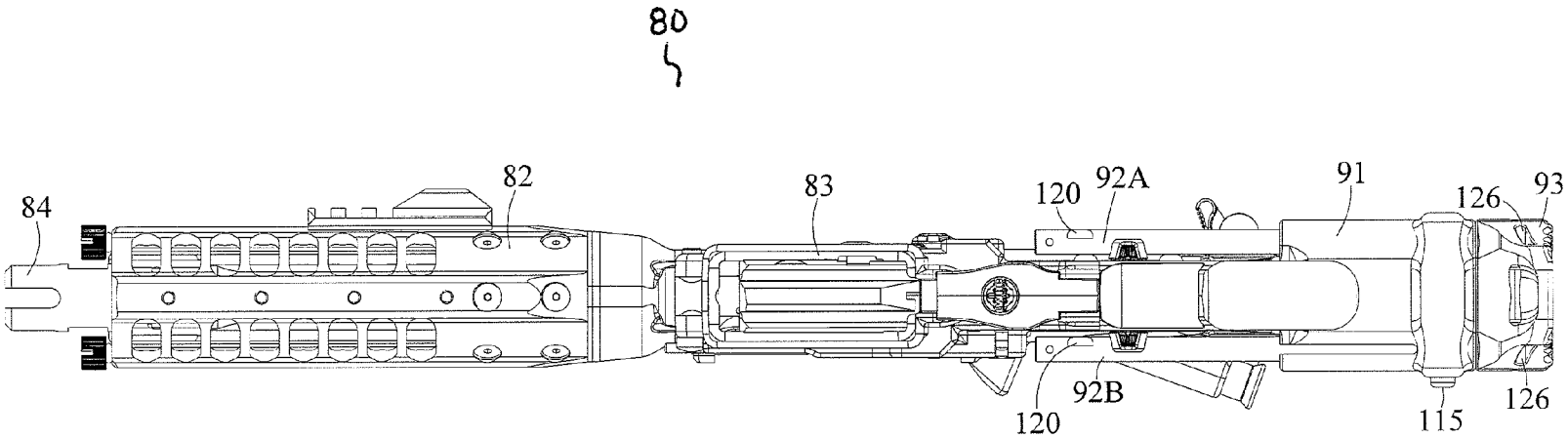
FIG. 6G is a bottom view of the firearm shown in FIG. 6A.

FIG. 5 shows a cutaway view of an embodiment bolt carrier 20 with attached bolt 11, firing pin 13, and cam pin 14. The bolt carrier 20 has an interior thru bore 21 extending between its rear end and the hammer clearance slot 26 (FIGS. 2-4) of sufficient diameter to facilitate the passage of the buffer's 40 shaft 42 portion. Further, the interior diameter of the thru bore 21 is smaller than the exterior diameter of either the bumper 41 or cylindrical weight 43 portions of the buffer 40. There is a countersunk bore 24 about the front end of the thru bore 21 configured to receive a portion of the cylindrical weight 43 and resist its rearward movement. Located on the back end 32 of the bolt carrier 20 is an annular side wall 25 which a portion of the bumper 41 contacts during the buffer's 40 rearward movements.

Figure 7:
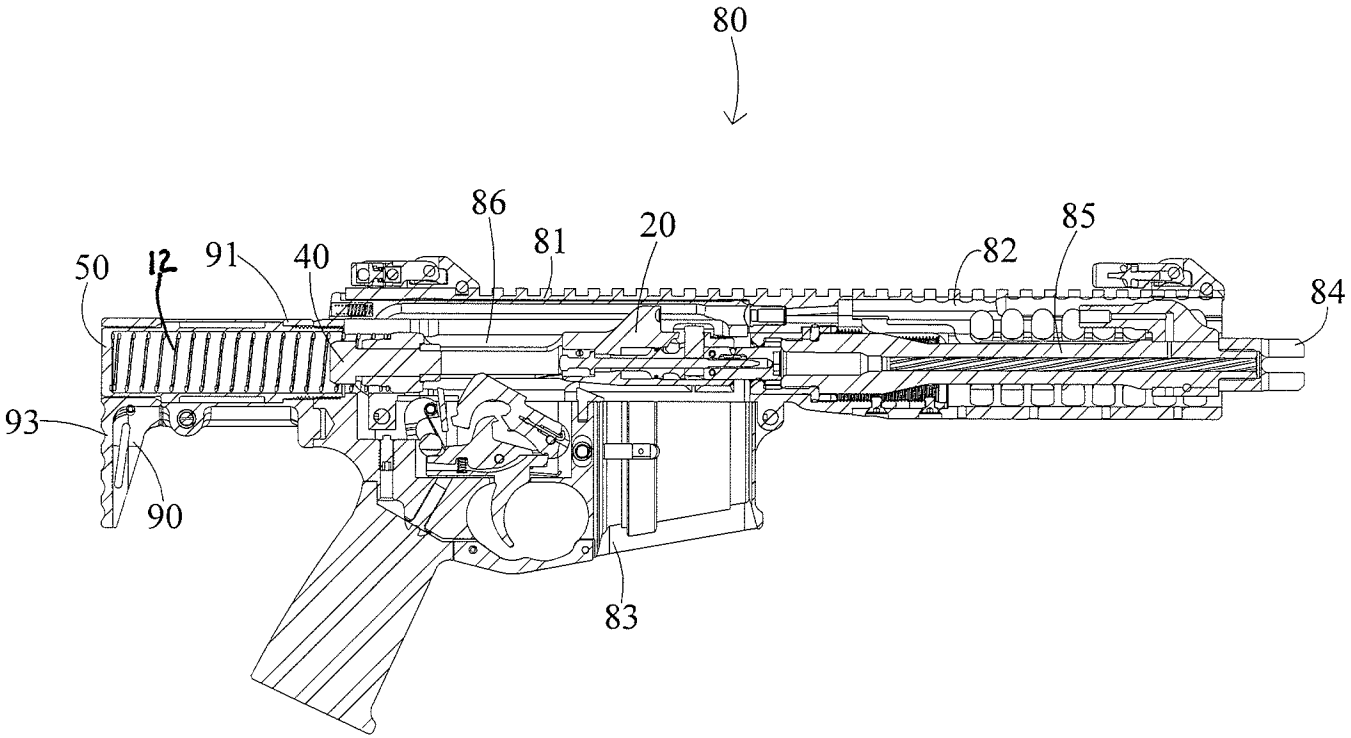
FIG. 7 is a partial cutaway view of the firearm shown in FIG. 6B showing the bolt carrier with attached buffer as it sits in relationship to the buffer tube prior to firing the rifle.

Views of a AR15/M16 type personal defense weapon (PDW), generally designated by reference numeral 80, used with one embodiment of the buffer assembly 10 and buttstock assembly 90 are shown in FIGS. 6A-6C, 6E-6G, and 7. FIG. 6A-6G show various views of the personal defense weapon 80, also referred to herein as a firearm, and the major components from which it is comprised. Specifically, the upper receiver assembly 81, lower receiver assembly 83, handguard 82, flash hider 84 and buttstock assembly 90 are shown. FIG. 7 shows a cutaway of the view illustrated in FIG. 6B. This view shows the linear relationship between the barrel 85, bolt carrier 20 with attached buffer 40, buffer spring 12 (see FIGS. 1B and 7), and the buffer tube 50. When the bolt carrier 20 is in battery a majority of the bolt carrier 20 and buffer 40 are present within the interior portion 86 of the upper receiver 81. A small portion of the buffer 40 extends into the buffer tube 50 (see FIG. 7). The PDW illustrated is equipped with an 8" barrel 85, giving the firearm an overall length of approximately 20".

Figure 8:
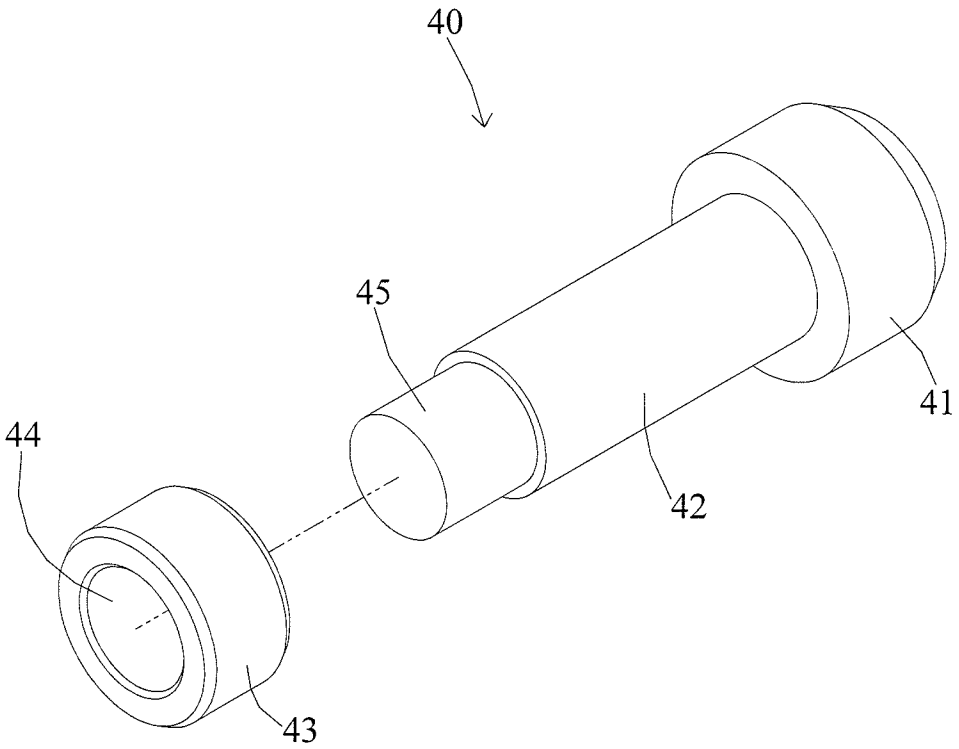
FIG. 8 is an exploded perspective view of the buffer shown in FIG. 1B.

Shown in FIG. 8 is the buffer 40 which generally consists of a cylindrically shaped weight 43 having an interior opening 44 there through and a bumper 41 portion having an integral shaft 42. The distil end 45 of the shaft 42 is smaller in diameter than the rest of the shaft 42 and is constructed to be received within the interior opening 44 of the cylindrical weight 43. The components which make up the buffer 40 are manufactured from tungsten steel, but other, metals, iron and steel alloys of sufficient weight/density would suffice. All components of the buffer 40 are weighted to reduce the occurrence of bolt bounce, to provide for proper dwell time and, in general, to facilitate the proper operation of the host firearm. The bumper 41 portion could have a softer material attached thereto to further buffer the firearms recoil cycle without departing from the scope of the claimed invention.

The buffer spring 12 shown in FIGS. 1B and 7 is a compression type spring having coils with a rectangular cross section. Alternatively, a traditional compression type spring with round coils could be substituted. In one embodiment, buffer spring 12 is manufactured from stainless steel but any material, such as chrome-silica, appropriate for use as a compression spring, is suitable.

Figure 9:
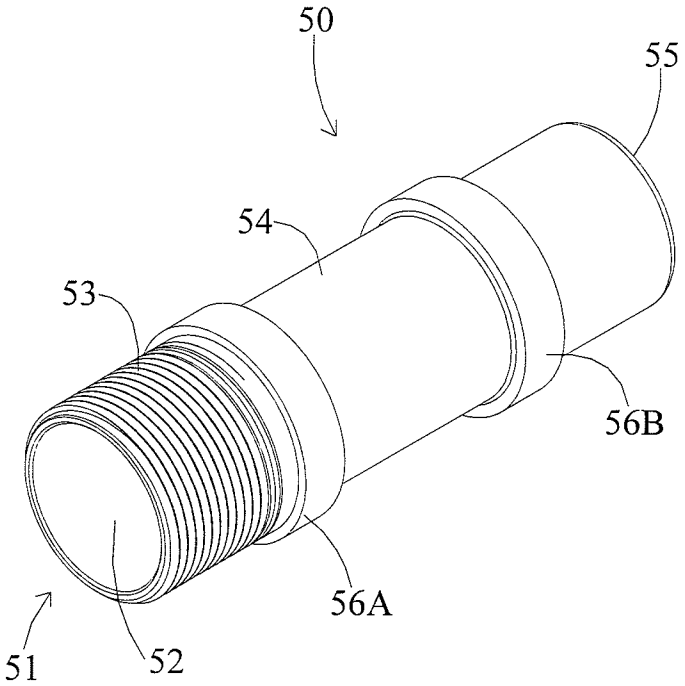
FIG. 9 is a perspective side view of the buffer tube shown in FIG. 1B, showing the opening into the interior bore 52 located on its front end.
Figure 11:
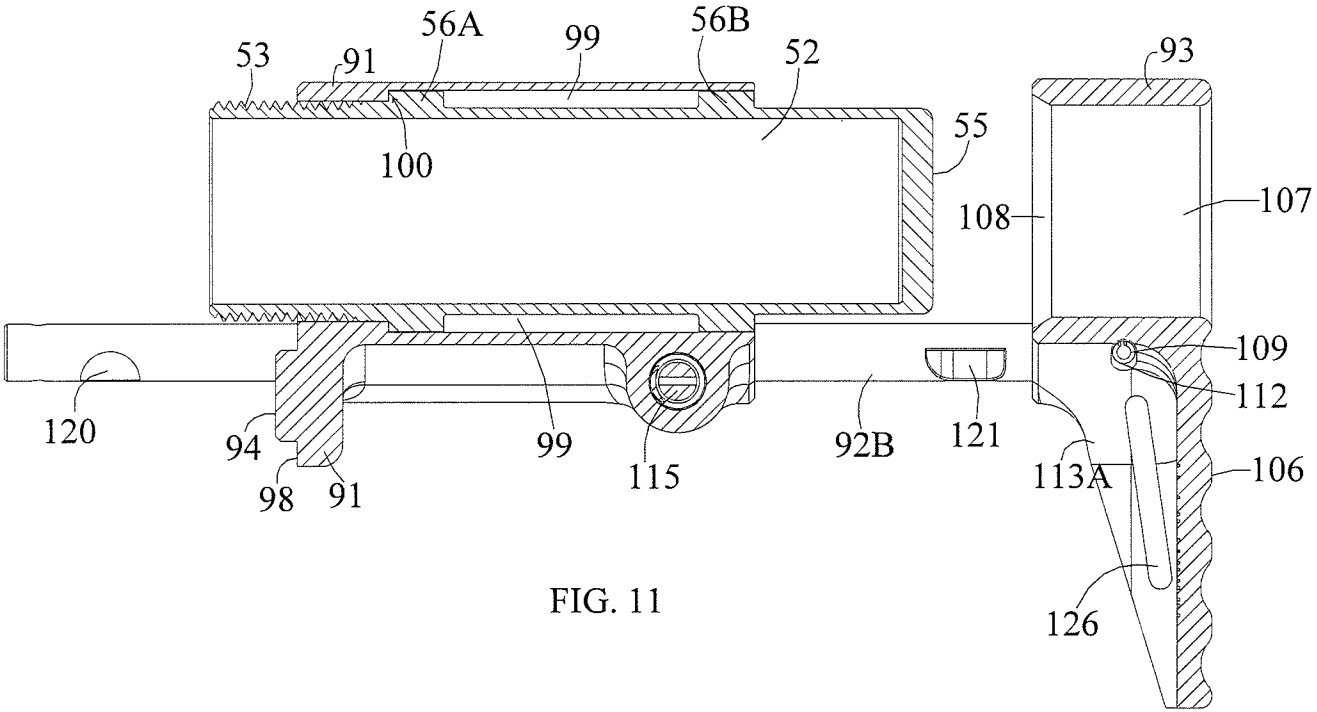
FIG. 11 is a perspective cutaway view of buttstock assembly while secured about the buffer tube.

As noted earlier, the bolt carrier 20 is received within a buffer tube 50, sometimes referred to as a receiver extension, which is shown in FIGS. 1B, 7, 9 and 11. The buffer tube 50 has an opening 51 on its front end which leads to a circular interior bore 52 sized to contain a portion of the buffer spring 12 and receive a portion of the bolt carrier 20 when it is rearwardly displaced during operation of the host firearm 80. The forward exterior of the buffer tube 50 body 54 is threaded 53 and constructed to be threadedly received within an interior opening present on the lower receiver 83. The back end 55 (FIG. 9) of the buffer tube 50 is closed on in the embodiment shown, alternate embodiments may have a small liquid drain hole (not shown). Located between the threads 53 on the front of the buffer tube 50 and the back end 55 of the buffer tube are two circumferential ridges 56A and 56B (FIG. 9). The circumferential ridges have a larger outer diameter than the body 54 of the buffer tube 50 and are used to support the housing 91 portion of buttstock assembly 90 as shown in FIG. 11.

Figure 10:
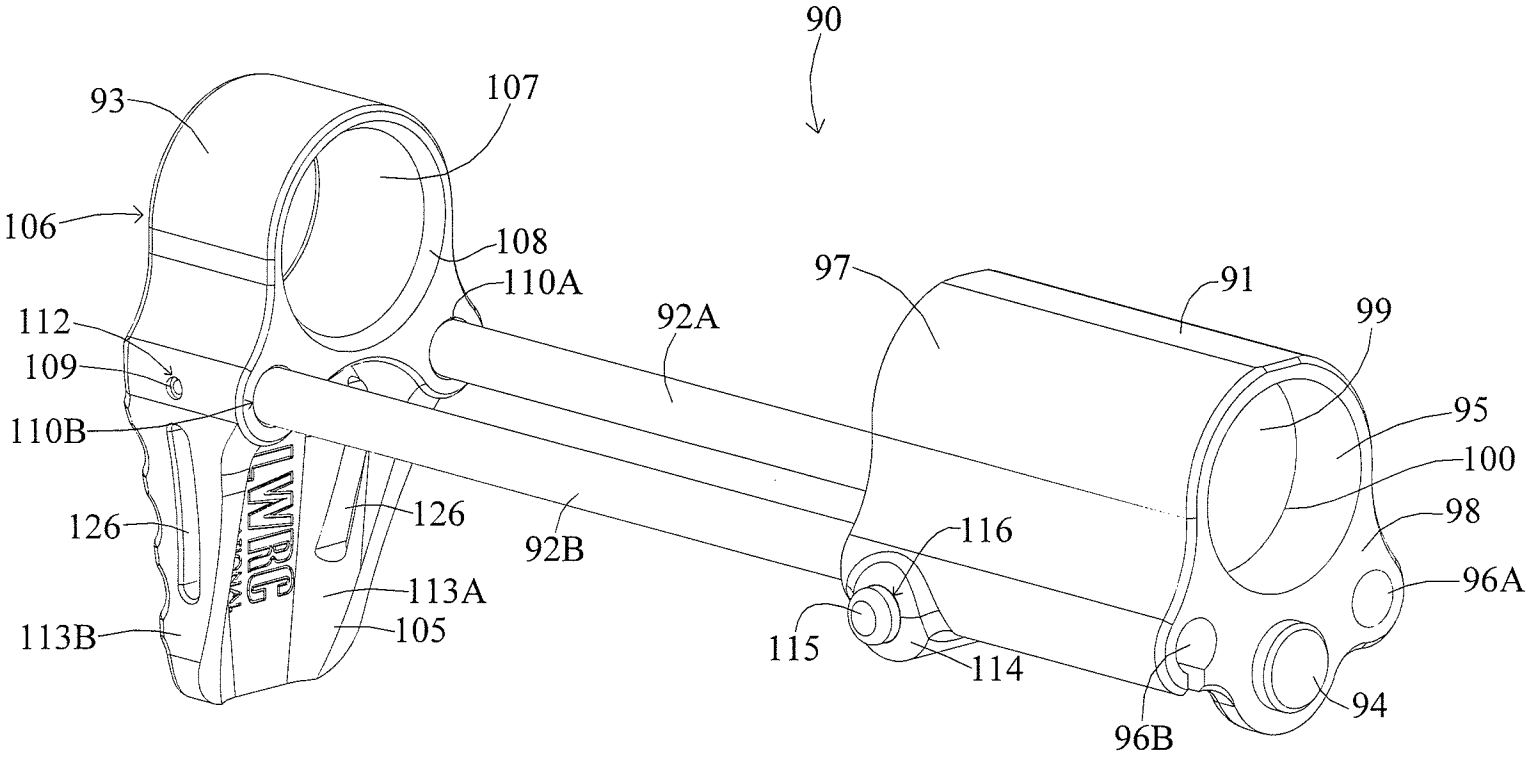
FIG. 10 is a perspective side view of the buttstock shown in FIGS. 6A-C and 6E-G, including a housing, guide rods, and a shoulder piece in accordance with the present invention.
Figure 13:
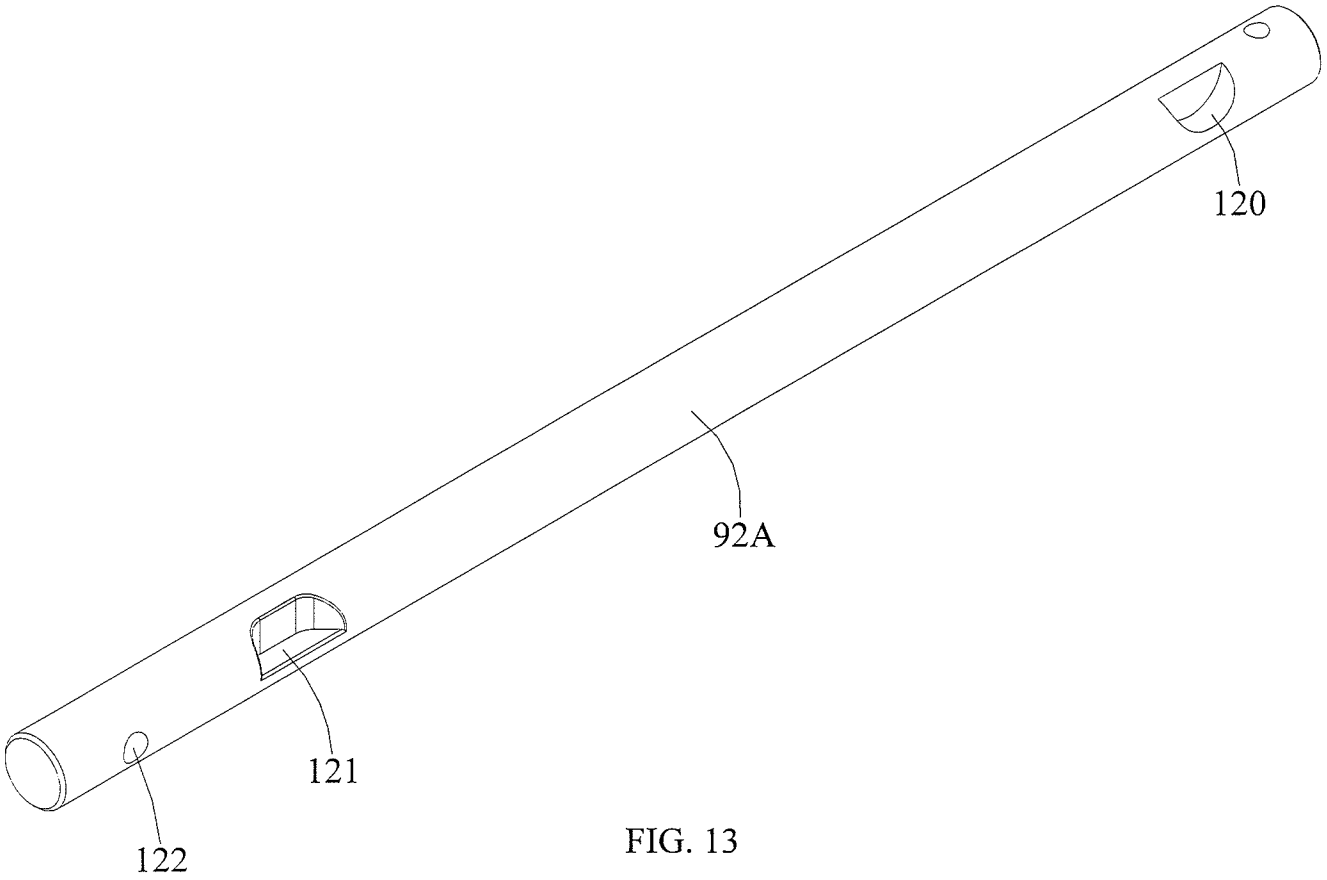
FIG. 13 is a perspective side view of a guide rod of the buttstock assembly as shown in FIG. 10.

The buttstock assembly 90 as shown in FIGS. 6A-6C, 6E-6G, 7 and 10-11 is comprised of three main components, a housing 91, shoulder stock 93 and two guide rods 92A and 92B (see FIGS. 10 and 13). The exterior surface of the housing 91 is contoured and shaped to act as a cheek piece 97 or comb. The interior of the housing 91 defines a longitudinally extending circular bore 99 sized to receive the buffer tube 50 (FIG. 10). The interior bore 99 is specifically sized such that the circumferential ridges 56A and 56B of the buffer tube make contact with the interior bore of the housing 91 (see FIG. 11). On the housing's 91 forward face 98 is a protrusion 94 (FIG. 10) which engages with an opening present on AR15/M16 type lower receivers 83 to prevent the unintentional rotation of the buttstock assembly 90 when assembled therewith. The housing 91 also defines thereon three openings, an opening 95 which allows the threaded portion 53 of the buffer tube 50 to pass through and two smaller openings 96A and 96B, which receive and support a portion of each guide rod 92A and 92B respectively. The opening 95 is smaller in diameter than the interior bore 99 thereby creating an internal shoulder 100 between the two.

Figure 12:
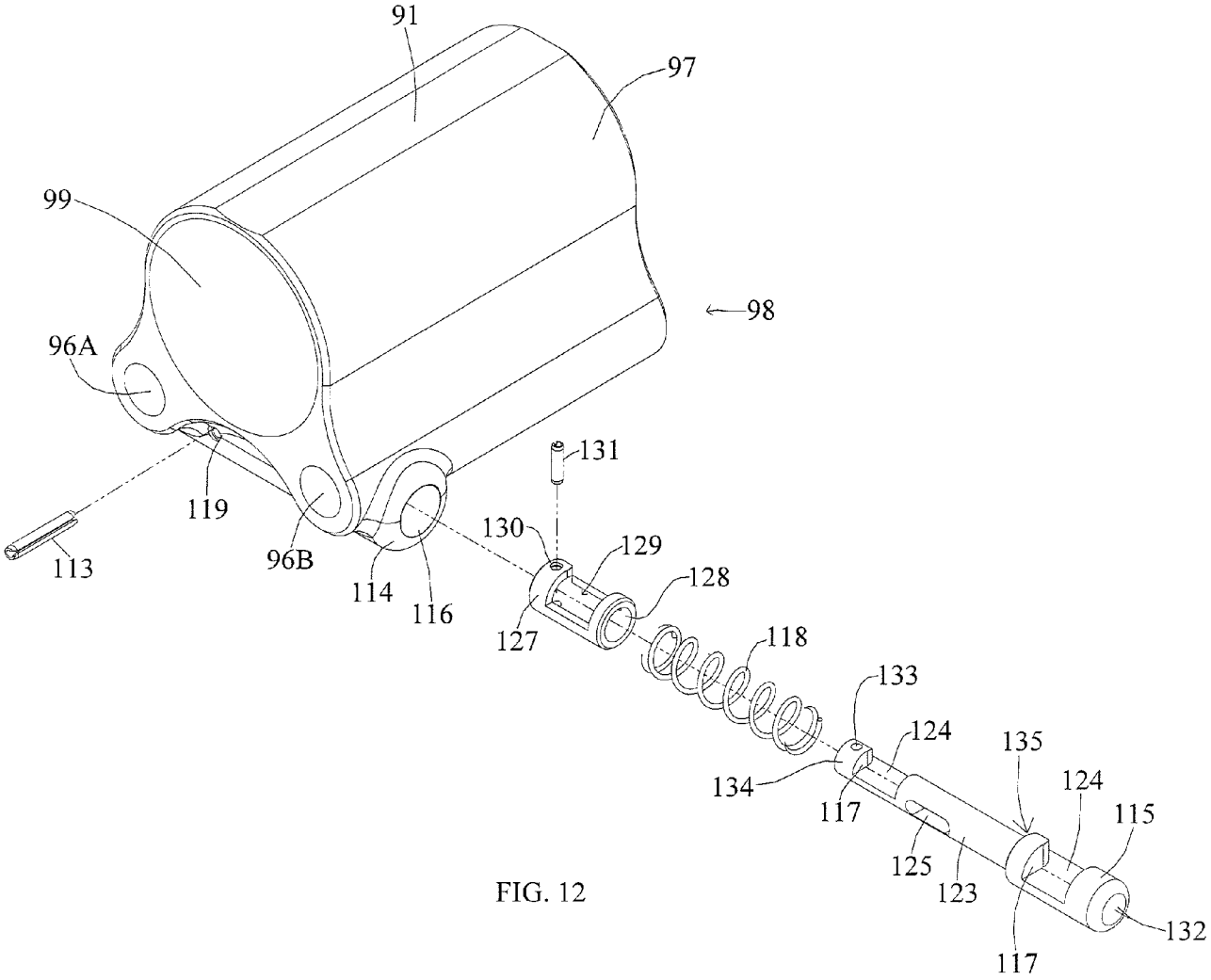
FIG. 12 is an exploded rear perspective view of the buttstock housing and catch mechanism in accordance with the present invention.

Located along the bottom side of the housing 91 is a placement 114 with an opening 116 that houses a spring 118 biased catch 115 used to operate the buttstock assembly 90 (FIG. 12). The opening 116 runs traverse to the longitudinal axis of the housing's 91 interior bore 99 and is in communication with an opening 119 configured to receive a roll pin 113 (FIG. 12). The catch 115 consists of two openings 124 with a cylindrical body 123 portion extending therebetween (FIG. 12). The cylindrical body 123 portion has a pressure pad 132 on the end opposite its distal end 134. The pressure pad 132 is the portion of the catch 115 to which the user applies force in order to operate the mechanism. One side of each opening 124 defines a detent 117 portion which is configured to engage with the notches 120 and 121 found on each guide rod, 92A and 92B (see FIGS. 12 and 13). The cylindrical body 123 of the catch 115 has a slot 125 therein constructed to receive a portion of the roll pin 113. Located at one end of the catch 115 is a bore 133 configured to receive a roll pin 131 (FIG. 12). Also provided is a spring 118, and a head piece 127. The head piece 127 has a generally cylindrical shape with a centrally placed, longitudinally extending aperture 128 through its center (FIG. 12). There is also a gap 129 through a side body portion of the head piece 127. Located at one end is a bore 130 configured to receive a roll pin 131.

To assemble the catch mechanism, the body portion 123 of the catch 115 is inserted through the central opening of the spring 118. The distil end 134 of the catch 115 is then inserted into the aperture 128 of the head piece 127, effectively capturing the spring 118 therebetween. Next, the bore 130 of the head piece 127 is aligned with the bore 133 of the body portion 123 then a roll pin 131 is pushed through both bores 130 and 133, thereby securing the two pieces together. The catch 115, with attached spring 118, is then inserted into the opening 116 of the housing 91. The catch 115 is oriented so that the bottom of each opening 124 is facing up (see FIG. 12), thereby placing the slot 125 in alignment with opening 119. A roll pin 113 is inserted through opening 119 into slot 125 in order to secure the catch 115 to the housing 91.

When the catch 115 is secured within the opening 116 provided on the housing 91, the spring 118 is captured between the roll pin 113 and a lip 135 formed between the body 123 and detent portion 117 of the catch 115. The spring 118 biases against the roll pin 113 when the pressure pad 132 of the catch 115 is actuated. In one embodiment, the housing 91 is constructed from aluminum. Alternatively, polymers or other suitable metals or metal alloys may be used.

The shoulder stock 93 defines a front side 105 and a back side 106 with a bore 107 extended therebetween (FIG. 10). The bore 107 defines a circular opening configured to receive the portion of the buffer tube 50 located between the back side 55 and the back face of circumferential ridge 56B (FIG. 11). There is a circumferential chamfer 108 located about the front side of the bore 107. Also found on the front side 105 are two openings 110A and 110B each configured to receive the back end of a guide rod 92A and 92B, respectively (FIG. 10). In one embodiment, shoulder stock 93 is manufactured from aluminum, but alternate embodiment configurations may be manufactured from polymers or other suitable metals without departing from the scope of this invention.

The back side 106, or butt, of the shoulder stock 93 is textured so as to provide a nonslip surface. Two side walls 113A and 113B are defined by the shoulder stock 93 (FIG. 10). There is a rectangular shaped opening 126 through each of the side walls 113A and 113B which provide mounting points for a rifle sling (FIG. 10).

The guide rods 92A and 92B are elongated, generally circular shaped rods each having two approximately semicircular notches 120 and 121 along one side (see FIGS. 11 and 13). Also present is a bore 122 (see FIG. 13) that runs transverse to the longitudinal axis of each guide rod 92A and 92B. This bore 122 is located near each guide rod's back end and is configured to receive a roll pin 109 (see FIGS. 11 and 13).

A portion of each guide rods 92A and 92B rearward end is received within a bore 110A and 110B found in the front side 105 of the shoulder stock 93 (FIG. 10). The shoulder stock 93 has two openings 112, one opening 112 in communication with each bore 110A and 110B (FIG. 10). The guide rods 92A and 92B are inserted into their respective bores 110A and 110B and are rotated until the bore 122 found on each guide rod 92A and 92B is aligned with the appropriate opening 112 of the shoulder stock 93 (FIGS. 10 and 13). A roll pin 109 is inserted through the aligned bore 122 and opening 112 of each guide rod 92A and 92B thereby securing them in place (FIGS. 10 and 11). In one embodiment, guide rods are manufactured from aluminum, but alternate embodiments could be manufactured from other light-weight and durable metal alloys.

The shoulder stock 93, with attached guide rods 92A and 92B, is slidably secured to the housing 91 as follows. Guide rod 92A and 92B are inserted within the longitudinally extending openings 96A and 96B of the housing respectively (FIG. 10). The guide rods 92A and 92B will slide freely forward until the forward notch 120 of each guide rods is engage by the detent 117 portion of the spring 118 biased catch 115, preventing further movement. This is referred to as the "first position" (see FIG. 10) of the shoulder stock 93 and is typically used when firing the attached firearm. To further collapse the shoulder stock 93 and move between the first and second positions, the catch 115 is depressed thereby disengaging the detents 117 from the forward notch 120 of each guide rod 92A and 92B. With the detents 117 disengaged, the shoulder stock 93 and guide rods 92A and 92B may be pushed forward until the detents 117 of the catch 115 engages with the rearward notch 121. This is referred to as the "second position" of the shoulder piece (see FIG. 6B). When the detents 117 engage with the rearward notches 121 of the guide rods, the bore 107 of the shoulder stock 93 also receives a portion of the buffer tube 50 therein. The second position of the shoulder stock 93 is typically selected when the host firearm is to be transported or stored. But, it is important to note that the second position of the shoulder stock 93 in no way inhibits the firearm from being used. To move the shoulder stock 93 back to the first position, simply pull on the shoulder stock and the detents 117 will slip out of the rear notch 121 of each guide rod 92A and 92B, allowing the shoulder stock 93 to extend until the detents 115 reengage with the forward notch 120 on each guide rod.

The gap between the guide rods 92A and 92B, and by extension the openings 96A and 96B which receive them, has to be large enough for the guide rods to clear the back end portion of the lower receiver 83 as shown in FIGS. 6A-6C, 6F and 6G.

To attach the buffer 40 to the bolt carrier 20, the shaft portion 42 of the bumper 41 is pushed through the enclosed thru bore 21 located on the back end 32 of the bolt carrier 20. The bumper 41 will come to rest against the annular side wall 25 located about the back end 32 of the bolt carrier 20 while the distil end 45 of the shaft 42 protrudes into the hammer clearance slot 26. The distil end 45 of the shaft 42 is received by the interior opening 44 of the cylindrical weight 43. The cylindrical weight 43 is then welded to the shaft 42, thereby making the buffer 40 an integral part of the bolt carrier 20. The cylindrical weight 43 is larger in diameter than the thru bore 21 housing the shaft 42, but smaller in diameter than the countersunk bore 24 where it is partially received during, at least, the forward movement of the bolt carrier 20. Once welded in place, the buffer 40 still has a limited range of longitudinal movement within the thru bore 21 of the bolt carrier 20.

On the back end 32 of the bolt carrier 20, extending between the boss 22 and the annular side wall 25 is the guide rod 23. The guide rod is a portion of the bolt carrier 20 that is smaller in diameter than the boss 22. The boss 22 defines a circular side wall 33 on its back side. The guide rod portion 23 of the bolt carrier 20 is constructed to be received within an interior portion of the buffer spring 12, with the forward most portion of the buffer spring 12 abutting the circular side wall 33 defined by the boss 22. The structure of the guide rod portion 23 prevents the buffer spring 12 from binding during operation.

The exterior diameter of the buffer spring 12 is no larger in diameter than the major diameter of the boss 22. This allows the boss 22 to be in direct contact with an interior portion 86 of the upper receiver 81 and the interior bore 52 of the buffer tube 50, without the spring 12 generating additional undesirable friction. The buffer spring 12 is able to bias the bolt carrier 20 into battery by placing its force against the circular side wall 33 of the boss 22. In addition, the guide rod portion 23 of the bolt carrier 20 helps to orient and keep the buffer spring 12 from binding up during the rearward movement of the bolt carrier 20.

To use the buffer assembly 10 with a firearm such as the PDW 80 shown in FIGS. 6A-6G and 7, the following steps must be taken. Initially, the housing 91 of the buttstock assembly 90 is placed against the back end of the lower receiver 83 so that the protrusion 94 on its forward face 98 engages therewith. The buffer tube 50 is inserted through the interior bore 52 of the housing 91 and threadedly secured to the lower receiver 83. The buffer tube 50 is rotated until the forward face of the circumferential ridge 56A (see FIG. 11) comes to rest against the shoulder 100 of the housing 91 thereby securing both the buffer tube and the housing of the buttstock assembly 90 to the lower receiver 83. The circumferential ridges 56A and 56B support the housing of the buttstock. The shoulder stock 93 with attached guide rods 92A and 92B may then be secured to the housing 91 as described above.

After the buffer 40 is secured to the bolt carrier 20 as described above, the buffer spring 12 is attached about the guide rod 23 portion of the bolt carrier 20. When properly seated in place, the forward edge of the spring 12 will rest against the circular side wall 33 defined by the boss 22. The guide rod portion 23 of the bolt carrier 20, the bumper 41 and a portion of the buffer 40 shaft 42 will be contained within an interior opening defined by the spring's 12 coils.

The bolt carrier 20 with attached buffer 40 and spring 12 are inserted into an interior portion 86 opening of the upper receiver 81 as follows. The interior portion 86 opening is a longitudinally extending bore configured to receive and facilitate the reciprocating movements of the bolt carrier 20 during the operation of the firearm 80. With the bolt carrier 20 seated in place, the spring 12 and a portion of the bumper 41 will be protruding from the rearward end of the upper receiver 81. The upper receiver 81 is then oriented such than the protruding spring 12 is in alignment with the interior bore 52 of the buffer tube 50 attached to the lower receiver 83. The rearward end of the spring 12 followed by a portion of the bumper 41 slide into the buffer tube 50. With the upper receiver 81 and lower receiver 83 now in operational orientation, the front take down pin 16A and rear take down pin 16B (FIG. 6B) are used to removably secure the two receivers together.

Thus the assembly of a firearm 80 using the new buffer assembly 10 and buttstock assembly 90 has been described. By reversing the steps outlined above, the bolt carrier 20, buffer 40, spring 12, and buttstock assembly 90 may be removed for routine maintenance and repair.

In one embodiment, buffer assembly 10 provided herein reduces the overall length of the AR15/M16 firearm by approximately 3.29". In alternate embodiments, the buffer assembly (and its individual components) could be dimensionally scaled up to work with AR15/M16/AR10 type firearms that rely on bolt carriers and buffer tubes of larger dimensions than those discussed herein in regards to the prior art. In doing so a proportionally smaller buffer assembly will be provided for such a firearm than is found in the prior art.

While one embodiment of the bolt carrier 20 shown is configured for use with a piston operated AR15/M16 type rifle, a bolt carrier modified to work with a more traditional direct impingent gas operating system which relies on a gas tube could be substituted without losing the benefits of the invention described and claimed herein.

A buffer retaining pin and a spring which biases it into place are common throughout the art as it relates to AR15/M16 type rifles. The buffer retaining pin is used to secure the separate buffer 320 within the buffer tube 330 (see FIG. 1A) and facilitate the assembly of so equipped firearms. The buffer assembly 10 described herein does not need a buffer retaining pin. By incorporating the buffer 40 onto the rear of the bolt carrier 20, a buffer retaining pin would serve no purpose. When assembling an AR15/M16 type rifle originally constructed to use a buffer retaining pin, the part should be omitted during the installation of the buffer assembly 10 described herein.

In an alternate embodiment, the buffer 40 could be secured to the bolt carrier 20 by threadedly securing the cylindrical weight 43 to the shaft 42.

In still another alternate embodiment, the bolt carrier 20 could be machined with the buffer 40, or a similarly weighted structure, as an integral part of its back end 32.

In still yet another alternate embodiment, a modified buffer having a body portion configured to be received within the thru bore 21 formed on the back end of a bolt carrier 20 could be manufactured. The modified buffer could be retained in place by sandwiching it between the back end 32 of the bolt carrier and the front end of the buffer spring 12.

In a further embodiment, the catch 115 could omit one of the openings 124 and detents 117 found along its length to simplify the mechanism.

In a still further embodiment, additional notches may be placed along the length of the guide rods 92A and 92B to provide for additional positions of adjustment, possibly making the stock more ergonomic for the user.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A gas-operated firearm comprising:

a receiver;

a barrel coupled to said receiver;

a bolt carrier, configured to be received within said receiver, having a weighted buffer assembly secured thereto;

a bolt;

a return spring for resisting the rearward movement of said bolt carrier and for biasing said bolt carrier into battery;

said bolt carrier including a front end where said bolt is rotatably mounted, a rear end defining an internal longitudinal opening where said weighted buffer assembly is housed, and a body portion extending therebetween, said weighted buffer assembly having a front portion, a rear portion and a connecting member extending therebetween, said rear portion of said weighted buffer assembly extends past the rear end of said bolt carrier, said connecting member is received within said internal longitudinal opening of said bolt carrier;

said rear end of said bolt carrier defines a boss thereon having an outer diameter that is in contact with an interior portion of said receiver, the area extending between the back side of said boss and the rear end of said bolt carrier is smaller in diameter that an interior opening of said return spring, a portion of which is received thereon.

2. The gas-operated firearm of claim 1, wherein said weighted buffer assembly has limited longitudinal movement in relationship to said bolt carrier.

3. The gas operated firearm of claim 1, further comprised of a buffer tube, said buffer tube defining a longitudinally extending interior opening and a generally cylindrical exterior having at least two circumferential ridges thereon, when secured to the gas-operated firearm said longitudinally extending interior opening is in operational alignment with said receiver.

4. The gas operated firearm of claim 3, further comprised of a buttstock assembly, said buttstock assembly is comprised of shoulder stock that is slidably connected to a housing, said housing constructed with an internal opening extending there through which is configured to receive at least a portion of said buffer tube, said at least two circumferential ridges of said buffer tube each have an outer diameter that is in contact with the interior of said internal opening of said housing when assembled therewith.

5. The gas operated firearm of claim 4, said internal opening of said housing has a front opening, a back opening and a bore extending therebetween, said front opening is smaller in diameter than said bore defining a shoulder therebetween, when said buffer tube is secured to said gas-operated firearm the forward most circumferential ridge bears against said shoulder thereby securing said stock to said gas-operated firearm.

* * * * *